US010933442B2

(12) United States Patent
Schmid et al.

(10) Patent No.: US 10,933,442 B2
(45) Date of Patent: Mar. 2, 2021

(54) PROCESSES FOR PRODUCING EFFECTS LAYERS

(71) Applicant: SICPA HOLDING SA, Prilly (CH)

(72) Inventors: Mathieu Schmid, Lausanne (CH); Claude-Alain Despland, Prilly (CH); Evgeny Loginov, Renens (CH); Cedric Amerasinghe, Les Cullayes (CH); Pierre Degott, Crissier (CH)

(73) Assignee: SICPA HOLDING SA, Prilly (CH)

( * ) Notice: Subject to any disclaimer, the term of this patent is extended or adjusted under 35 U.S.C. 154(b) by 731 days.

(21) Appl. No.: 15/103,565

(22) PCT Filed: Nov. 14, 2014

(86) PCT No.: PCT/EP2014/074630
§ 371 (c)(1),
(2) Date: Jun. 10, 2016

(87) PCT Pub. No.: WO2015/086257
PCT Pub. Date: Jun. 18, 2015

(65) Prior Publication Data

US 2016/0325310 A1 Nov. 10, 2016

(30) Foreign Application Priority Data

Dec. 13, 2013 (EP) ..... 13197160

(51) Int. Cl.
*B05D 3/00* (2006.01)
*B05D 5/06* (2006.01)
(Continued)

(52) U.S. Cl.
CPC ..... *B05D 3/207* (2013.01); *B05D 5/065* (2013.01); *B42D 25/29* (2014.10); *B42D 25/369* (2014.10);
(Continued)

(58) Field of Classification Search
CPC ..... B05D 5/066; B05D 5/06
See application file for complete search history.

(56) References Cited

U.S. PATENT DOCUMENTS 2,418,479 A 4/1947 Carlton et al.
2,570,856 A 10/1951 Carlton et al.
(Continued)

FOREIGN PATENT DOCUMENTS

CN 1668391 9/2005
DE 2006848 9/1971
(Continued)

OTHER PUBLICATIONS

"Special Effect Pigments", G. Pfaff, 2nd Revised Edition, 2008, pp. 43 and 116-117.
(Continued)

*Primary Examiner* — Tabassom Tadayyon Eslami
(74) *Attorney, Agent, or Firm* — Muncy, Geissler, Olds & Lowe, P.C.

(57) ABSTRACT

The disclosure relates to the field of the protection of security documents, such as for example banknotes and identity documents against counterfeit and illegal reproduction. In particular, the present disclosure provides processes for producing optical effect layers (OELs) on a substrate and OELs obtained thereof, said process including two magnetic orientation steps: a step of exposing a coating composition having platelet-shaped magnetic or magnetisable pigment particles to a dynamic magnetic field of a first magnetic-field-generating device so as to bi-axially orient at least a part of the platelet-shaped magnetic or magnetisable pigment particles, and a step of exposing the coating composition to a static magnetic field of a second magnetic-field-
(Continued)

generating device, thereby mono-axially re-orienting at least a part of the platelet-shaped magnetic or magnetisable pigment particles.

16 Claims, 4 Drawing Sheets

(51) Int. Cl.

| | |
|---|---|
| ***H01F 41/16*** | (2006.01) |
| ***B42D 25/29*** | (2014.01) |
| ***B42D 25/369*** | (2014.01) |
| ***B42D 25/378*** | (2014.01) |

(52) U.S. Cl.
CPC ..... *B42D 25/378* (2014.10); *H01F 41/16* (2013.01); *B42D 2033/16* (2013.01); *B42D 2033/20* (2013.01); *B42D 2035/20* (2013.01)

(56) References Cited

U.S. PATENT DOCUMENTS

| | | | | |
|---|---|---|---|---|
| 3,676,273 | A | 7/1972 | Graves et al. | |
| 3,791,864 | A | 2/1974 | Steingroever | |
| 4,518,627 | A | 5/1985 | Foley et al. | |
| 4,838,648 | A | 6/1989 | Phillips et al. | |
| 5,364,689 | A | 11/1994 | Kashiwagi et al. | |
| 5,630,877 | A | 5/1997 | Kashiwagi et al. | |
| 6,103,361 | A | 8/2000 | Batzar et al. | |
| 6,410,130 | B1 | 6/2002 | Schuhmacher et al. | |
| 6,531,221 | B1 | 3/2003 | Schuhmacher et al. | |
| 6,582,781 | B1 | 6/2003 | Schuhmacher et al. | |
| 6,759,097 | B2 | 7/2004 | Phillips et al. | |
| 6,838,166 | B2 | 1/2005 | Phillips et al. | |
| 7,047,883 | B2 | 5/2006 | Raksha et al. | |
| 7,517,578 | B2 | 4/2009 | Raksha et al. | |
| 8,025,952 | B2 | 9/2011 | Raksha et al. | |
| 8,343,615 | B2 | 1/2013 | Raksha et al. | |
| 2002/0160194 | A1 | 10/2002 | Phillips et al. | |
| 2002/0182383 | A1* | 12/2002 | Phillips ..... | B05D 3/20 428/199 |
| 2004/0009308 | A1 | 1/2004 | Schlaf et al. | |
| 2004/0051297 | A1 | 3/2004 | Raksha et al. | |
| 2006/0081151 | A1* | 4/2006 | Raksha ..... | B41M 3/144 106/31.92 |
| 2006/0194040 | A1 | 8/2006 | Raksha et al. | |
| 2007/0172261 | A1 | 7/2007 | Raksha et al. | |
| 2013/0084411 | A1 | 4/2013 | Raksha et al. | |

FOREIGN PATENT DOCUMENTS

| | | |
|---|---|---|
| DE | 102004035866 | 2/2006 |
| EP | 0406667 | 1/1995 |
| EP | 0710508 | 5/1996 |
| EP | 0686675 | 2/1998 |
| EP | 1710756 | 10/2006 |
| EP | 2157141 | 2/2010 |
| EP | 1819525 | 3/2010 |
| EP | 2165774 | 3/2010 |
| EP | 1666546 | 10/2010 |
| EP | 2263806 | 12/2010 |
| EP | 2263807 | 12/2010 |
| EP | 2306222 | 4/2011 |
| EP | 2325677 | 5/2011 |
| EP | 2402401 | 1/2012 |
| EP | 2468423 | 6/2012 |
| EP | 1878773 | 8/2012 |
| EP | 1674282 | 6/2013 |
| JP | 2009090624 | 4/2009 |
| JP | 2009530093 | 8/2009 |
| WO | 2002073250 | 9/2002 |
| WO | 2002009002 | 11/2002 |
| WO | 2003000801 | 1/2003 |
| WO | 2004007095 | 1/2004 |
| WO | 2005002866 | 1/2005 |
| WO | 2006061301 | 6/2006 |
| WO | 2006063926 | 6/2006 |
| WO | 2007107549 | 9/2007 |
| WO | 2007131833 | 11/2007 |
| WO | 2008046702 | 4/2008 |
| WO | 2010058026 | 5/2010 |
| WO | 2011012520 | 2/2011 |
| WO | 2011092502 | 8/2011 |
| WO | 2011107271 | 9/2011 |
| WO | 2012038531 | 3/2012 |
| WO | 2012104098 | 8/2012 |
| WO | 2012165037 | 12/2012 |
| WO | 2013167425 | 11/2013 |

OTHER PUBLICATIONS

Printing Technology, J. M. Adams and P. A. Dolin, Delmar Thomson Learning, 5th Edition.

Chemistry & Technology of UV & EB Formulation for Coatings, Inks & Paints, vol. III, "Photoinitiators for Free Radical Cationic and Anionic Polymerization", 2nd edition, by J. V. Crivello & K. Dietliker, edited by G. Bradley and published in 1998 by John Wiley & Sons in association with SITA Technology Limited.

Z.Q. Zhu et D. Howe (Halbach permanent magnet machines and applications: a review, IEE. Proc. Electric Power Appl., 2001, 148, p. 299-308).

Russian office action and Search Report in counterpart Russian Application No. 2016127983, dated Oct. 17, 2017 (and English language translation of Relevant Excerpt).

Japanese office action in counterpart Japanese Application No. P2016-530969 dated May 15, 2018 (along with English language translation).

Chinese Office Action in counterpart Chinese Application No. CN201480067298.6 dated Oct. 30, 2019 (and English language translation of the Office Action).

* cited by examiner

PROCESSES FOR PRODUCING EFFECTS LAYERS

CROSS-REFERENCE TO RELATED APPLICATIONS

The present application is a National Stage Application of International Application No. PCT/EP2014/074630 filed Nov. 14, 2014, which published as WO 2015/086257 A1 on Jun. 18, 2015, the disclosures of which are expressly incorporated by reference herein in their entireties. Further, the present application claims priority to European Application No. 13197160.8, filed Dec. 13, 2013, the disclosure of which is expressly incorporated by reference herein in its entirety.

BACKGROUND OF THE DISCLOSURE

1. Field of the Disclosure

The present disclosure relates to the field of processes for producing optical effect layers (OEL) comprising magnetically oriented platelet-shaped magnetic or magnetisable pigment particles. In particular, the present disclosure provides processes for producing said OELs as anti-counterfeit measures on security documents or security articles or for decorative purposes.

2. Background Description

It is known in the art to use inks, compositions, coatings or layers containing oriented magnetic or magnetisable pigment particles, particularly also optically variable magnetic or magnetisable pigment particles, for the production of security elements, e.g., in the field of security documents. Coatings or layers comprising oriented magnetic or magnetisable pigment particles are disclosed for example in U.S. Pat. Nos. 2,570,856; 3,676,273; 3,791,864; 5,630,877 and 5,364,689. Coatings or layers comprising oriented magnetic color-shifting pigment particles, resulting in particularly appealing optical effects, useful for the protection of security documents, have been disclosed in WO 2002/090002 A2 and WO 2005/002866 A1.

Security features, e.g., for security documents, can generally be classified into "covert" security features on the one hand, and "overt" security features on the other hand. The protection provided by covert security features relies on the concept that such features are difficult to detect, typically requiring specialized equipment and knowledge for detection, whereas "overt" security features rely on the concept of being easily detectable with the unaided human senses, e.g., such features may be visible and/or detectable via the tactile senses while still being difficult to produce and/or to copy. However, the effectiveness of overt security features depends to a great extent on their easy recognition as a security feature.

Magnetic or magnetisable pigment particles in printing inks or coatings allow for the production of magnetically induced images, designs and/or patterns through the application of a corresponding magnetic field, causing a local orientation of the magnetic or magnetisable pigment particles in the unhardened coating, followed by hardening the latter. The result is a fixed magnetically induced image, design or pattern. Materials and technologies for the orientation of magnetic or magnetisable pigment particles in coating compositions have been disclosed in U.S. Pat. Nos. 2,418,479; 2,570,856; 3,791,864, DE 2006848-A, U.S. Pat. Nos. 3,676,273, 5,364,689, 6,103,361, EP0406 667 B1; US 2002/0160194; US 2004/0051297, now U.S. Pat. No. 7,047,883; US 2004/0009309, now U.S. Pat. No. 7,258,900; EP 0 710 508 A1; WO 2002/09002 A2; WO 2003/000801 A2; WO 2005/002866 A1; WO 2006/061301 A1; these documents are incorporated herein by reference. In such a way, magnetically induced patterns which are highly resistant to counterfeit can be produced. The security element in question can only be produced by having access to both, the magnetic or magnetisable pigment particles or the corresponding ink, and the particular technology employed to print said ink and to orient said pigment in the printed ink.

Examples of dynamic security features based on magnetically induced images, designs or patterns providing the optical illusion of movement have been developed including without limitation rolling-bar effects and moving rings effects.

For example, U.S. Pat. No. 7,047,883 discloses the creation of a dynamic optically variable effect known as the "rolling bar" feature. The "rolling bar" feature provides the optical illusion of movement to images comprising oriented magnetic or magnetisable pigments. U.S. Pat. No. 7,517,578 and WO 2012/104098 A1 respectively disclose "double rolling bar" and "triple rolling bar" features, said features seeming to move against each other upon tilting. A printed "rolling bar" type image shows one or more contrasting bands which appear to move ("roll") as the image is tilted with respect to the viewing angle. Such images are known to be easily recognized by the man on the street and the illusive aspect cannot be reproduced by commonly available office equipment for color scanning, printing and copying.

For example, U.S. Pat. No. 8,343,615, EP 2325677, WO 2011/092502 and US 2013/0084411 now U.S. Pat. No. 9,257,059 disclose moving-ring images displaying an apparently moving ring with changing viewing angle ("rolling ring" or "moving ring" effect).

The literature, such as for example in "Special Effect Pigments", G. Pfaff, $2^{nd}$ Revised Edition, 2008, pages 43 and 116-117, teaches that large reflective particles are preferred for producing images, designs or patterns because they have a large flat surface, and exhibit a uniform reflection of incident light, thus leading to excellent lustre and brilliance, whereas small particles exhibit an increased light scattering and refraction, thus causing reduced light reflection and inferior brilliance. Furthermore, it is known in the art that the qualities expressed by saturation, brightness, opacity of inks or compositions are affected by the size of the so-comprised pigment particles. For example, large optical effect pigment particles exhibit a higher chroma than corresponding smaller pigment particles. Therefore, the ordinarily-skilled artisan typically uses reflective pigment particles having a large size, in particular optically variable pigment particles or optically variable magnetic or magnetisable pigment particles for producing optical effect layers. For example, the prior art discloses particles with an individual particle size within a range between 2 and 200 μm (microns). WO 2002/073250 A1 discloses optically variable magnetic or magnetisable pigment particles having a size between 20 and 30 μm. WO 2011/012520 A2 discloses flake-shaped particles having a diameter of typically between 10 to 50 μm. WO 2006/061301 A1 discloses that a large particle size (flake diameter in the range of 10 to 50 μm) and a size distribution that is as homogeneous as possible, are desirable, in order to yield the optimum effect. U.S. Pat. No. 8,025,952 discloses that the typical size of magnetic particles for inks is in the range of from 10 μm to 100 μm.

As taught by the prior art, optically reflective non-spherical pigment particles having a large size, in particular optically variable non-spherical pigment particles having a large size, have been widely preferred for producing optical effect layers. While there are only limited indications available in the art describing preferred particle sizes for reflective non-spherical magnetic or magnetisable pigment particles or optically variable non-spherical magnetic or magnetisable pigment particles, those indications also point towards large particle sizes to obtain magnetically oriented optical effect layers with high reflectivity, chroma and/or colorshifting properties when applied as a coating. Optically reflective non-spherical pigment particles having a large size, in particular optically variable non-spherical pigment particles having a large size, have a tendency to align without any external force parallel to the optical effect layer surface as a consequence of their large size, thereby producing higher reflective optical effect layers. The reflectivity of optical effect layers produced with optically reflective non-spherical pigment particles having a small size is negatively impacted as a consequence of the increased light scattering resulting from the increased numbers of pigment particles edges and the fact that the pigments are more randomly oriented than in layers produced with coating compositions comprising larger particles.

Therefore, a need remains for processes to produce optical effect layers (OELs) based on magnetically oriented platelet-shaped pigment particles, said OELs being sophisticated and/or displaying an eye-catching dynamic effect and exhibiting a high contrast and/or improved reflectivity in comparison with the prior art.

SUMMARY OF THE DISCLOSURE

Accordingly, it is an aim of the present disclosure to overcome the deficiencies of the prior art as discussed above. This is achieved by the provision of a process for producing an optical effect layer (OEL) on a substrate, said process comprising the steps of:

a) applying on a substrate surface a coating composition comprising: i) platelet-shaped magnetic or magnetisable pigment particles, and ii) a binder material, said coating composition being in a first state, b) exposing the coating composition to a dynamic magnetic field of a first magnetic-field-generating device so as to bi-axially orient at least a part of the platelet-shaped magnetic or magnetisable pigment particles, c) exposing the coating composition of step b) to a static magnetic field of a second magnetic-field-generating device, thereby mono-axially re-orienting at least a part of the platelet-shaped magnetic or magnetisable pigment particles, and d) hardening the coating composition of step c) to a second state so as to fix the platelet-shaped magnetic or magnetisable pigment particles in their adopted positions and orientations.

Also described herein are OELs produced by the process described herein and security documents as well as decorative elements or objects comprising one or more optical OELs described herein.

Also described herein methods of manufacturing a security document or a decorative element or object, comprising:

providing a security document or a decorative element or object, and providing an optical effect layer such as those described herein, in particular such as those obtained by the process described herein, so that it is comprised by the security document or decorative element or object.

The present disclosure enables the use of platelet-shaped magnetic or magnetisable pigment particles, irrespective of their particle size, to produce optical effect layers exhibiting high chroma, brightness, high contrast, and high resolution. Furthermore, very small platelet-shaped magnetic or magnetisable pigment particles (that are traditionally considered as an inferior grade compared to large magnetic or magnetisable pigment particles known in the art to produce high quality and high resolution magnetically induced images) may be used to provide high quality OELs. By allowing the use of platelet-shaped magnetic or magnetisable pigment particles, irrespective of their particle size, the process described herein advantageously provides the freedom to use more classical or conventional printing elements, such as screen printing, flexography, rotogravure and intaglio printing. Moreover, the OELs produced by the process described herein and using small pigment particles may also have a reduced thickness, and therefore an increased flexibility in comparison with the prior art, and thus exhibit an improvement in application or printing versatility while maintaining or improving optical properties, resolution and reflectivity. Moreover, several optical effect layers may also be more easily superimposed without excessively increasing the total thickness of the stack.

BRIEF DESCRIPTION OF THE DRAWINGS

The optical effect layer (OEL) described herein and its production are now described in more detail with reference to the drawings and to particular embodiments, wherein.

DETAILED DESCRIPTION OF EMBODIMENTS OF THE DISCLOSURE

Definitions

Figure 1:
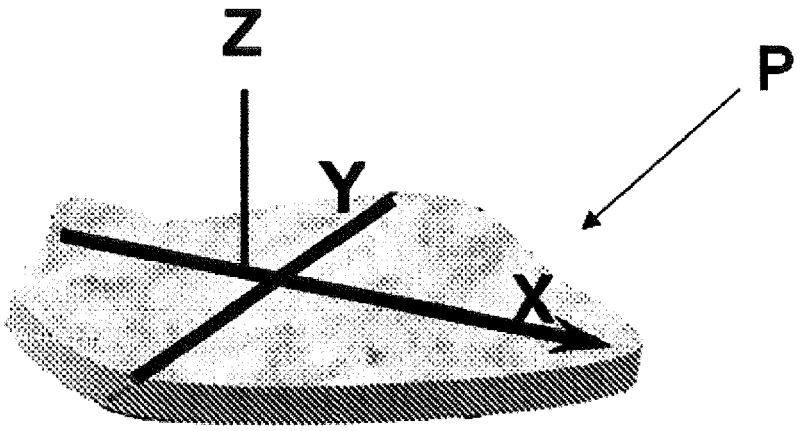
FIG. 1 schematically illustrates a platelet-shaped pigment particle.

The following definitions are to be used to interpret the meaning of the terms discussed in the description and recited in the claims.

As used herein, the indefinite article "a" indicates one as well as more than one and does not necessarily limit its referent noun to the singular.

As used herein, the term "about" indicates that the amount, value or limit in question may be the specific value designated or some other value in its neighbourhood. Generally, the term "about" denoting a certain value is intended to denote a range within ±5% of the value. As one example, the phrase "about 100" denotes a range of 100±5, i.e. the range from 95 to 105. Generally, when the term "about" is used, it can be expected that similar results or effects according to the disclosure can be obtained within a range of ±5% of the indicated value. However, a specific amount, value or limit supplemented with the term "about" is intended herein to disclose as well the very amount, value or limit as such, i.e. without the "about" supplement.

As used herein, the term "and/or" indicates that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20° from parallel alignment. Preferably, the term "substantially parallel" refers to not deviating more than 10° from parallel alignment.

The term "at least partially" is intended to denote that the following property is fulfilled to a certain extent or completely. Preferably, the term denotes that the following property is fulfilled to at least 50% or more.

The terms "substantially" and "essentially" are used to denote that the following feature, property or parameter is either completely (entirely) realized or satisfied or to a major degree that does adversely affect the intended result. Thus, the term "substantially" or "essentially" preferably indicates at least 80%.

The term "comprising" as used herein is intended to be non-exclusive and open-ended. Thus, for instance a coating composition comprising a compound A may include other compounds besides A. However, the term "comprising" also covers, as a particular embodiment thereof, the more restrictive meanings of "consisting essentially of" and "consisting of", so that for instance "a coating composition comprising a compound A" may also (essentially) consist of the compound A.

The term "coating composition" refers to any composition which is capable of forming an optical effect layer on a solid substrate and which can be applied preferentially but not exclusively by a printing method. The coating composition comprises at least the platelet-shaped magnetic or magnetisable pigment particles described herein and a binder.

The term "optical effect layer (OEL)" as used herein denotes a layer that comprises magnetically oriented platelet-shaped magnetic or magnetisable pigment particles and a binder, wherein the orientation of the platelet-shaped magnetic or magnetisable pigment particles is fixed within the binder so as to form a magnetically induced image.

As used herein, the term "optical effect coated substrate (OEC)" is used to denote the product resulting from the provision of the OEL on a substrate. The OEC may consist of the substrate and the OEL, but may also comprise other materials and/or layers other than the OEL.

The term "security element" or "security feature" is used to denote an image or graphic element that can be used for authentication purposes. The security element or security feature can be an overt and/or a covert security element.

The term "partially simultaneously" as used herein denotes that two steps are partly performed simultaneously, i.e. the times of performing each of the steps partially overlap.

In one aspect, the present disclosure relates to processes for producing optical effect layers (OEL) as well as optical effect layers (OEL) obtained therefrom and optical effect coatings (OEC); i.e. substrates comprising one or more OEL obtained therefrom. The process according to the present disclosure comprises the steps of:

a) applying on a substrate surface the coating composition described herein, said coating composition being in a first state, b) exposing the coating composition to the dynamic magnetic field of a magnetic-field-generating device so as to bi-axially orient at least a part of the platelet-shaped magnetic or magnetisable pigment particles, c) exposing the coating composition of step b) to the static magnetic field of a second magnetic-field-generating device, thereby mono-axially re-orienting at least a part of platelet-shaped magnetic or magnetisable pigment particles, and d) hardening the coating composition of step c) to a second state so as to fix the platelet-shaped magnetic or magnetisable pigment particles in their adopted positions and orientations.

In contrast to needle-shaped pigment particles which can be considered as one-dimensional particles, platelet-shaped pigment particles P are two-dimensional particles due to the large aspect ratio of their dimensions as can be seen in FIG. 1. As shown in FIG. 1, a platelet-shaped pigment particle P can be considered as a two-dimensional structure wherein the dimensions X and Y are substantially larger than dimension Z. Platelet-shaped pigment particles P are also referred in the art as oblate particles or flakes. Such pigment particles P may be described with a main axis X corresponding to the longest dimension crossing the pigment particle P and a second axis Y perpendicular to X which also lies within said pigment particles P.

Since the coating composition described herein is to be provided on a substrate surface, it is necessary that the coating composition comprising at least the binder material and the platelet-shaped magnetic or magnetisable pigment particles is in a form that allows processing of the coating composition. The applying step a) described herein is preferably carried out by a printing process preferably selected from the group consisting of screen printing, rotogravure printing, flexography printing and intaglio printing (also referred in the art as engraved copper plate printing and engraved steel die printing), more preferably selected from the group consisting of screen printing, rotogravure printing and flexography printing. These processes are well-known to the skilled man and are described for example in Printing Technology, J. M. Adams and P. A. Dolin, Delmar Thomson Learning, $5^{th}$ Edition. Further, subsequently to, partially simultaneously or simultaneously with the application of the coating composition described herein on the substrate surface described herein, the platelet-shaped magnetic or magnetisable pigment particles are oriented by applying a succession of magnetic fields so as to align the platelet-shaped magnetic or magnetisable pigment particles along the field lines. Subsequently to or partially simultaneously with the steps of orienting/aligning the platelet-shaped magnetic or magnetisable pigment particles by applying magnetic fields, the orientation of the platelet-shaped magnetic or magnetisable pigment particles is fixed or frozen. The coating composition must have a first state, i.e. a liquid or pasty state, wherein the coating composition is wet or soft enough, so that the platelet-shaped magnetic or magnetisable pigment particles dispersed in the coating composition are freely movable, rotatable and/or orientable upon exposure to a magnetic field, and a second hardened (e.g., solid) state, wherein the platelet-shaped magnetic or magnetisable pigment particles are fixed or frozen in their respective positions and orientations.

Such a first and second state is preferably provided by using a certain type of coating composition. For example, the components of the coating composition other than the platelet-shaped magnetic or magnetisable pigment particles may take the form of an ink or coating composition such as those which are used in security applications, e.g., for banknote printing. The aforementioned first and second states can be provided by using a material that shows an increase in viscosity in reaction to a stimulus such as for example a temperature change or an exposure to an electromagnetic radiation. That is, when the fluid binder material is hardened or solidified, said binder material converts into the second state, i.e. a hardened or solid state, where the platelet-shaped magnetic or magnetisable pigment particles are fixed in their current positions and orientations and can no longer move nor rotate within the binder material.

As known to those skilled in the art, ingredients comprised in an ink or coating composition to be applied onto a surface such as a substrate and the physical properties of said ink or coating composition must fulfil the requirements of the process used to transfer the ink or coating composition to the substrate surface. Consequently, the binder material comprised in the ink or coating composition described herein is typically chosen among those known in the art and depends on the coating or printing process used to apply the ink or coating composition and the chosen hardening process.

The OEL described herein comprises platelet-shaped magnetic or magnetisable pigment particles that, due to their shape, have non-isotropic reflectivity. The platelet-shaped magnetic or magnetisable pigment particles are dispersed in the binder material being at least partially transparent to electromagnetic radiation of one or more wavelength ranges in the range of 200 nm to 2500 nm and have a specific orientation for providing a desired optical effect.

The orientation of the platelet-shaped magnetic or magnetisable pigment particles in the binder material to obtain the OEL described herein is achieved by two orientation steps, said steps being carried out by i) bi-axially orienting the platelet-shaped magnetic or magnetisable pigment particles in accordance with an external dynamic magnetic field of a first magnetic-field-generating device, and subsequently ii) mono-axially re-orienting the platelet-shaped magnetic or magnetisable pigment particles in accordance with a static external magnetic field of a second magnetic-field-generating device.

Carrying out a bi-axial orientation indicates that the platelet-shaped magnetic or magnetisable pigment particles are made to orientate in such a way that their two main axes are constrained. That is, each platelet-shaped magnetic or magnetisable pigment particle can be considered to have a major axis in the plane of the pigment particle and an orthogonal minor axis in the plane of the pigment particle. The major and minor axes of the platelet-shaped magnetic or magnetisable pigment particles are each caused to orient according to the dynamic magnetic field. Effectively, this results in neighbouring platelet-shaped magnetic pigment particles that are close to each other in space to be essentially parallel to each other. In order to perform a bi-axial orientation, the platelet-shaped magnetic pigment particles must be subjected to a strongly time-dependent external magnetic field.

Put another way, bi-axial orientation aligns the planes of the platelet-shaped magnetic or magnetisable pigment particles so that the planes of said pigment particles are oriented to be essentially parallel relative to the planes of neighbouring (in all directions) platelet-shaped magnetic or magnetisable pigment particles. In an embodiment, both the major axis and the minor axis perpendicular to the major axis described hereabove of the planes of the platelet-shaped magnetic or magnetisable pigment particles are oriented by the dynamic magnetic field so that neighbouring (in all directions) pigment particles have their major and minor axes aligned with each other.

Carrying out a mono-axial orientation step indicates that the platelet-shaped magnetic pigment particles are made to orientate in such a way that only the orientation of their main axis is constrained. Effectively, this results in neighbouring platelet-shaped magnetic pigment particles having their main (longest) axis parallel to each other, while their minor axis in the plane of the platelet-shaped magnetic or magnetisable pigment particles is not constrained. Consequently, planes of neighbouring platelet-shaped magnetic pigment particles are not necessarily parallel after a mono-axial orientation step. In order to perform mono-axial orientation, the particles are subjected to an essentially static magnetic field.

According to one embodiment, the step of carrying out a bi-axial orientation of the platelet-shaped magnetic or magnetisable pigment particles leads to a magnetic orientation wherein the platelet-shaped magnetic or magnetisable pigment particles have their two main axes substantially parallel to the substrate surface. For such an alignment, the platelet-shaped magnetic or magnetisable pigment particles are planarised within the coating composition on the substrate and are oriented with both their X-axis and Y-axis shown in FIG. 1 parallel with the substrate surface.

According to another embodiment, the step of carrying a bi-axial orientation of the platelet-shaped magnetic or magnetisable pigment particles leads to a magnetic orientation wherein the platelet-shaped magnetic or magnetisable pigment particles have a first axis within the X-Y plane substantially parallel to the substrate surface and a second axis being perpendicular to said first axis at a substantially non-zero elevation angle to the substrate surface.

According to another embodiment, the step of carrying a bi-axial orientation of the platelet-shaped magnetic or magnetisable pigment particles leads to a magnetic orientation wherein the platelet-shaped magnetic or magnetisable pigment particles have their X-Y plane parallel to an imaginary spheroid surface.

According to another aspect of the present disclosure, there is provided a process for producing an optical effect layer (OEL) on a substrate, said process comprising the steps of:

a) applying on a substrate surface a coating composition comprising i) platelet-shaped magnetic or magnetisable pigment particles and ii) a binder material, said coating composition being in a first state, b) exposing the coating composition to a dynamic magnetic field of a first magnetic-field-generating device to dynamically change an orientation of at least a part of the platelet-shaped magnetic or magnetisable pigment particles according to the dynamic magnetic field in a region of the coating composition, preferably so as to cause planes of neighbouring (in all directions) platelet-shaped magnetic or magnetisable pigment particles of said at least part of the pigment particles to be essentially parallel to each other in the (macroscopic) region of the coating composition, c) exposing the coating composition of step b) to a static magnetic field of a second magnetic-field-generating device, thereby aggregately re-orienting at least some of the platelet-shaped magnetic or magnetisable pigment particles in the region, and d) hardening the coating composition of step c) to a second state so as to fix the platelet-shaped magnetic or magnetisable pigment particles in their adopted positions and orientations.

The coating compositions described herein comprise platelet-shaped magnetic or magnetisable pigment particles comprising a magnetic material and having a particle size (d50) from about 1 μm to about 200 μm. Herein the term "size" denotes a statistical property of the ensemble of platelet-shaped magnetic or magnetisable pigment particles. As known in the art, pigment particles, flake pigments and other comminuted materials can be characterized by measuring a particle size distribution (PSD) of a sample. Such PSDs typically describe the fractional amount (relative to total number, weight or volume) of particles in the sample as a function of a size-related characteristic of individual particles. A commonly used size-related characteristic describing individual particles is the "circle equivalent" (CE) diameter, which corresponds to the diameter of a circle that would have the same area as an orthographic projection of the particle. It is common in the art to express a PSD as the relative volume of particles as a function of the CE diameter, and for platelet-shaped particles, the volume is calculated as proportional to the CE diameter to the power of 2. This definition of a PSD will be used throughout the present application. For convenience, statistics of PSDs are calculated from the results using the CE diameter rather than reporting the entire PSD. In this application, standard percentile readings are reported: D(v,50) (hereafter abbreviated as d50) is the value of the CE diameter, in microns, which separates the PSD in two parts of equal cumulated volume: the lower part represent 50% of the cumulated volume of all particles, corresponding to those particles with a CE diameter smaller than d50; the upper part represents 50% of the cumulated volume of particles, corresponding to those particles with a CE diameter larger than d50. d50 is also known as the median of the volume distribution of particles.

A variety of experimental methods are available to measure PSD's including without limitation sieve analysis, electrical conductivity measurements (using a Coulter counter), laser diffraction and direct optical granulomtery. Direct optical granulometry was used to determine PSDs cited in this application (instrument: Malvern Morphologi G3; sample preparation: 0.2 wt-% pigment particle dispersion in a solvent-based varnish, screen-printed using a 90T mesh on glass microscope slides).

As mentioned hereabove, the process described herein enables the use of platelet-shaped magnetic or magnetisable pigment particles, irrespective of their particle size within the range from about 1 μm to about 200 μm described herein, to produce OELs exhibiting high chroma, brightness, high contrast and high resolution. By allowing the use of platelet-shaped magnetic or magnetisable pigment particles, irrespective of their particle size, the process described herein advantageously provides the versatility in the printing process of the coating composition. The size of platelet-shaped magnetic or magnetisable pigment particles described herein should be selectively chosen so as to generate OELs exhibiting optimum optical properties for screen printing, rotogravure printing, flexography printing, intaglio printing or equivalent methods used in the art. Typically platelet-shaped magnetic or magnetisable pigment particles having a particle size (d50) from about 1 μm to about 200 μm are particularly suitable for coating techniques. Typically platelet-shaped magnetic or magnetisable pigment particles having a particle size (d50) from about 1 μm to about 50 μm are particularly suitable for screen printing. Typically platelet-shaped magnetic or magnetisable pigment particles having a particle size (d50) from about 1 μm to about 25 μm are particularly suitable for rotogravure printing and flexography printing. Typically platelet-shaped magnetic or magnetisable pigment particles having a particle size (d50) from about 1 μm to about 30 μm are particularly suitable for intaglio printing. Moreover, the OELs produced by the process described herein while using small pigment particles, may also advantageously have a reduced thickness, and therefore a increased flexibility in comparison with the prior art, and thus exhibit an improvement of printing performance while maintaining or improving optical properties, resolution and reflectivity.

In the OEL described herein, the platelet-shaped magnetic or magnetisable pigment particles are provided in such a manner as to form a visually dynamic element, in particular a dynamic security element. Herein, the term "dynamic appearance" denotes that the appearance and the light reflection of the element changes depending on the viewing angle. Put differently, the appearance of the security element is different when viewed from different angles, i.e., the security element exhibits a different appearance, e.g., when viewed from a viewing angle of about 90° as compared to a viewing angle of about 22.5°, both with respect to the plane of the OEL. This "dynamic appearance" behaviour is caused by the orientation of the platelet-shaped magnetic or magnetisable pigment particles having non-isotropic reflectivity and/or by the properties of the platelet-shaped magnetic or magnetisable pigment particles as such, having a viewing angle dependent appearance (such as platelet-shaped optically variable magnetic or magnetisable pigment particles described later).

Due to their platelet shape, the reflectivity of the platelet-shaped magnetic of magnetisable pigment particles is non-isotropic as the visible area of the particle depends on the direction from which it is viewed. In one embodiment, the platelet-shaped magnetic or magnetisable pigment particles having non-isotropic reflectivity due to their non-spherical shape may further have an intrinsic non-isotropic reflectivity, such as for instance in platelet-shaped optically variable magnetic or magnetisable pigment particles, due to their structure comprising layers of different reflectivity and refractive indexes. In this embodiment, the platelet-shaped magnetic or magnetisable pigment particles comprise platelet-shaped magnetic or magnetisable pigment particles having intrinsic non-isotropic reflectivity, such as platelet-shaped optically variable magnetic or magnetisable pigment particles.

Suitable examples of platelet-shaped magnetic or magnetisable pigment particles described herein include without limitation pigment particles comprising a magnetic metal selected from the group consisting of cobalt (Co), iron (Fe), gadolinium (Gd), and nickel (Ni); a magnetic alloy of iron, manganese, cobalt, nickel, or a mixture of two or more thereof; a magnetic oxide of chromium, manganese, cobalt, iron, nickel, or a mixture of two or more thereof; or a mixture of two or more thereof. The term "magnetic" in reference to the metals, alloys and oxides is directed to ferromagnetic or ferrimagnetic metals, alloys and oxides. Magnetic oxides of chromium, manganese, cobalt, iron, nickel, or a mixture of two or more thereof may be pure or mixed oxides. Examples of magnetic oxides include without limitation iron oxides such as hematite ($Fe_2O_3$), magnetite ($Fe_3O_4$), chromium dioxide ($CrO_2$), magnetic ferrites ($MFe_2O_4$), magnetic spinels ($MR_2O_4$), magnetic hexaferrites ($MFe_{12}O_{19}$), magnetic orthoferrites ($RFeO_3$), magnetic garnets $M_3R_2(AO_4)_3$, wherein M represents two-valent metal, R represents three-valent metal, and A represents four-valent metal.

Examples of platelet-shaped magnetic or magnetisable pigment particles described herein include without limitation pigment particles comprising a magnetic layer M made from one or more of a magnetic metal such as cobalt (Co), iron (Fe), gadolinium (Gd), or nickel (Ni); and a magnetic alloy of iron, cobalt, or nickel, wherein said platelet-shaped magnetic or magnetisable pigment particles may be multilayered structures comprising one or more additional layers. Preferably, the one or more additional layers are layers A independently made from one or more materials selected from the group consisting of metal fluorides such as magnesium fluoride ($MgF_2$), silicium oxide (SiO), silicium dioxide ($SiO_2$), titanium oxide ($TiO_2$), zinc sulphide (ZnS), and aluminium oxide ($Al_2O_3$), more preferably silicium dioxide ($SiO_2$); or layers B independently made from one or more materials selected from the group consisting of metals and metal alloys, preferably selected from the group consisting of reflective metals and reflective metal alloys, and more preferably selected from the group consisting of aluminium (Al), chromium (Cr), and nickel (Ni), and still more preferably aluminium (Al); or a combination of one or more layers A such as those described hereabove and one or more layers B such as those described hereabove. Typical examples of the platelet-shaped magnetic or magnetisable pigment particles being multilayered structures described hereabove include without limitation A/M multilayer structures, A/M/A multilayer structures, A/M/B multilayer structures, A/B/M/A multilayer structures, A/B/M/B multilayer structures, A/B/M/B/A multilayer structures, B/M multilayer structures, B/M/B multilayer structures, B/A/M/A multilayer structures, B/A/M/B multilayer structures, B/A/M/B/A/multilayer structures, wherein the layers A, the magnetic layers M and the layers B are chosen from those described hereabove.

Due to their magnetic characteristics, the platelet-shaped magnetic or magnetisable pigment particles described herein are machine readable, and therefore coating compositions comprising those pigment particles may be detected for example with specific magnetic detectors. Coating compositions comprising the platelet-shaped magnetic or magnetisable pigment particles described herein may therefore be used as a covert or semi-covert security element (authentication tool) for security documents.

Optically variable elements, such as for example pigment particles, inks, coatings or layers are known in the field of security printing. Optically variable elements (also referred in the art as colorshifting or goniochromatic elements) exhibit a viewing-angle or incidence-angle dependent color, and are used to protect banknotes and other security documents against counterfeiting and/or illegal reproduction by commonly available color scanning, printing and copying office equipment.

The platelet-shaped magnetic or magnetisable pigment particles may comprise platelet-shaped optically variable magnetic or magnetisable pigment particles and/or platelet-shaped magnetic or magnetisable pigment particles having no optically variable properties. Preferably, at least a part of the platelet-shaped magnetic or magnetisable pigment particles described herein is constituted by platelet-shaped optically variable magnetic or magnetisable pigment particles.

In addition to the overt security provided by the colorshifting property of optically variable magnetic or magnetisable pigment particles, which allows easily detecting, recognizing and/or discriminating an article or security document carrying an ink, coating composition, coating or layer comprising the platelet-shaped optically variable magnetic or magnetisable pigment particles described herein from their possible counterfeits using the unaided human senses, the optical properties of the platelet-shaped optically variable magnetic or magnetisable pigment particles may also be used as a machine readable tool for the recognition of the OEL. Thus, the optical properties of the platelet-shaped optically variable magnetic or magnetisable pigment particles may simultaneously be used as a covert or semi-covert security feature in an authentication process wherein the optical (e.g., spectral) properties of the pigment particles are analyzed. The use of platelet-shaped optically variable magnetic or magnetisable pigment particles in coating compositions for producing an OEL enhances the significance of the OEL as a security feature in security document applications, because such materials (i.e., platelet-shaped optically variable magnetic or magnetisable pigment particles) are reserved to the security document printing industry and are not commercially available to the public.

As mentioned above, preferably at least a part of the platelet-shaped magnetic or magnetisable pigment particles is constituted by platelet-shaped optically variable magnetic or magnetisable pigment particles. These can more preferably be selected from the group consisting of platelet-shaped magnetic thin-film interference pigment particles, platelet-shaped magnetic cholesteric liquid crystal pigment particles, platelet-shaped interference coated pigment particles comprising a magnetic material, and mixtures of two or more thereof.

Platelet-shaped magnetic thin film interference pigment particles are known to those skilled in the art and are disclosed e.g. in U.S. Pat. No. 4,838,648; WO 2002/073250 A2; EP 0 686 675 B1; WO 2003/000801 A2; U.S. Pat. No. 6,838,166; WO 2007/131833 A1; EP 2 402 401 A1 and in the documents cited therein. Preferably, the platelet-shaped magnetic thin film interference pigment particles comprise pigment particles having a five-layer Fabry-Perot multilayer structure and/or pigment particles having a six-layer Fabry-Perot multilayer structure and/or pigment particles having a seven-layer Fabry-Perot multilayer structure.

Preferred five-layer Fabry-Perot multilayer structures consist of absorber/dielectric/reflector/dielectric/absorber multilayer structures wherein the reflector and/or the absorber is also a magnetic layer, preferably the reflector and/or the absorber is: a magnetic layer comprising nickel, iron, and/or cobalt; and/or a magnetic alloy comprising nickel, iron, and/or cobalt; and/or a magnetic oxide comprising nickel (Ni), iron (Fe), and/or cobalt (Co).

Preferred six-layer Fabry-Perot multilayer structures consist of absorber/dielectric/reflector/magnetic/dielectric/absorber multilayer structures.

Preferred seven-layer Fabry Perot multilayer structures consist of absorber/dielectric/reflector/magnetic/reflector/dielectric/absorber multilayer structures such as disclosed in U.S. Pat. No. 4,838,648.

Preferably, the reflector layers described herein are independently made from one or more materials selected from the group consisting of metals and metal alloys, preferably selected from the group consisting of reflective metals and reflective metal alloys, more preferably selected from the group consisting of aluminium (Al), silver (Ag), copper (Cu), gold (Au), platinum (Pt), tin (Sn), titanium (Ti), palladium (Pd), rhodium (Rh), niobium (Nb), chromium (Cr), nickel (Ni), and alloys thereof, even more preferably selected from the group consisting of aluminium (Al), chromium (Cr), nickel (Ni), and alloys thereof, and still more preferably aluminium (Al). Preferably, the dielectric layers are independently made from one or more materials selected from the group consisting of metal fluorides such as magnesium fluoride ($MgF_2$), aluminium fluoride ($AlF_3$), cerium fluoride ($CeF_3$), lanthanum fluoride ($LaF_3$), sodium aluminium fluorides (e.g. $Na_3AlF_6$), neodymium fluoride ($NdF_3$), samarium fluoride ($SmF_3$), barium fluoride ($BaF_2$), calcium fluoride ($CaF_2$), and lithium fluoride (LiF), and metal oxides, such as silicium oxide (SiO), silicium dioxide ($SiO_2$), titanium oxide ($TiO_2$), and aluminium oxide ($Al_2O_3$), more preferably selected from the group consisting of magnesium fluoride ($MgF_2$), and silicium dioxide ($SiO_2$), and still more preferably magnesium fluoride ($MgF_2$). Preferably, the absorber layers are independently made from one or more materials selected from the group consisting of aluminium (Al), silver (Ag), copper (Cu), palladium (Pd), platinum (Pt), titanium (Ti), vanadium (V), iron (Fe), tin (Sn), tungsten (W), molybdenum (Mo), rhodium (Rh), Niobium (Nb), chromium (Cr), nickel (Ni), metal oxides thereof, metal sulfides thereof, metal carbides thereof, and metal alloys thereof, more preferably selected from the group consisting of chromium (Cr), nickel (Ni), metal oxides thereof, and metal alloys thereof, and still more preferably selected from the group consisting of chromium (Cr), nickel (Ni), and metal alloys thereof. Preferably, the magnetic layer comprises nickel (Ni), iron (Fe), and/or cobalt (Co); and/or a magnetic alloy comprising nickel (Ni), iron (Fe), and/or cobalt (Co); and/or a magnetic oxide comprising nickel (Ni), iron (Fe), and/or cobalt (Co). When magnetic thin film interference pigment particles comprising a seven-layer Fabry-Perot structure are preferred, it is particularly preferred that the magnetic thin film interference pigment particles comprise a seven-layer Fabry-Perot absorber/dielectric/reflector/magnetic/reflector/dielectric/absorber multilayer structure consisting of a Cr/$MgF_2$/Al/M/Al/$MgF_2$/Cr multilayer structure, wherein M a magnetic layer comprising nickel (Ni), iron (Fe) and/or cobalt (Co); and/or a magnetic alloy comprising nickel (Ni), iron (Fe) and/or cobalt (Co); and/or a magnetic oxide comprising nickel (Ni), iron (Fe) and/or cobalt (Co).

The magnetic thin film interference pigment particles described herein may be multilayer pigment particles being considered as safe for human health and the environment and being based for example on five-layer Fabry-Perot multilayer structures, six-layer Fabry-Perot multilayer structures and seven-layer Fabry-Perot multilayer structures, wherein said pigment particles include one or more magnetic layers comprising a magnetic alloy having a substantially nickel-free composition including about 40 wt-% to about 90 wt-% iron, about 10 wt-% to about 50 wt-% chromium, and about 0 wt-% to about 30 wt-% aluminium. Typical examples of multilayer pigment particles being considered as safe for human health and the environment can be found in EP 2 402 401 A1 which is hereby incorporated by reference in its entirety.

Platelet-shaped magnetic thin film interference pigment particles described herein are typically manufactured by a conventional deposition technique for the different required layers onto a web. After deposition of the desired number of layers, e.g., by physical vapour deposition (PVD), chemical vapour deposition (CVD), or electrolytic deposition, the stack of layers is removed from the web, either by dissolving a release layer in a suitable solvent, or by stripping the material from the web. The so-obtained material is then broken down to platelet-shaped pigment particles, which have to be further processed by grinding, milling (such as, for example, jet milling processes) or any suitable method so as to obtain pigment particles of the required size. The resulting product consists of flat platelet-shaped pigment particles with broken edges, irregular shapes and different aspect ratios. Further information on the preparation of suitable platelet-shaped magnetic thin film interference pigment particles can be found e.g. in EP 1 710 756 A1 and EP 1 666 546 A1 which are hereby incorporated by reference in their entireties.

Suitable platelet-shaped magnetic cholesteric liquid crystal pigment particles exhibiting optically variable characteristics include without limitation magnetic monolayered cholesteric liquid crystal pigment particles and magnetic multilayered cholesteric liquid crystal pigment particles. Such pigment particles are disclosed for example in WO 2006/063926 A1, U.S. Pat. Nos. 6,582,781 and 6,531,221. WO 2006/063926 A1 discloses monolayers and pigment particles obtained therefrom with high brilliance and color-shifting properties with additional particular properties such as magnetisability. The disclosed monolayers and pigment particles, which are obtained therefrom by comminuting said monolayers, include a three-dimensionally crosslinked cholesteric liquid crystal mixture and magnetic nanoparticles. U.S. Pat. Nos. 6,582,781 and 6,410,130 disclose platelet-shaped cholesteric multilayer pigment particles which comprise the sequence $A_1$/B/$A_2$, wherein $A_1$ and $A_2$ may be identical or different and each comprises at least one cholesteric layer, and B is an interlayer absorbing all or some of the light transmitted by the layers $A_1$ and $A_2$, and imparting magnetic properties to said interlayer. U.S. Pat. No. 6,531,221 discloses platelet-shaped cholesteric multilayer pigment particles which comprise the sequence A/B and optionally C, wherein A and C are absorbing layers comprising pigment particles imparting magnetic properties, and B is a cholesteric layer.

Suitable platelet-shaped interference coated pigments comprising one or more magnetic materials include without limitation structures consisting of a substrate selected from the group consisting of a core coated with one or more layers, wherein at least one of the core or the one or more layers have magnetic properties. For example, suitable platelet-shaped interference coated pigments comprise a core made of a magnetic material, such as those described hereabove, said core being coated with one or more layers made of one or more metal oxides, or they have a structure consisting of a core made of synthetic or natural micas, layered silicates (e.g., talc, kaolin, and sericite), glasses (e.g., borosilicates), silicium dioxides ($SiO_2$), aluminium oxides ($Al_2O_3$), titanium oxides ($TiO_2$), graphites, and mixtures of two or more thereof. Furthermore, one or more additional layers such as colouring layers may be present.

The platelet-shaped magnetic or magnetisable pigment particles described herein may be surface treated so at to protect them against any deterioration that may occur in the coating composition and/or to facilitate their incorporation in the coating composition; typically corrosion inhibitor materials and/or wetting agents may be used.

Preferably, the coating composition described herein comprises the platelet-shaped magnetic or magnetisable pigment particles described herein dispersed in a binder material. Preferably, the platelet-shaped magnetic or magnetisable pigment particles are present in an amount from about 2 wt-% to about 40 wt-%, more preferably about 4 wt-% to about 30 wt-%, the weight percents being based on the total weight of the coating composition comprising the binder material, the platelet-shaped magnetic or magnetisable pigment particles and other optional components of the coating composition.

In addition to the platelet-shaped magnetic or magnetisable pigment particles (which may or may not comprise or consist of platelet-shaped optically variable magnetic or magnetisable pigment particles), also non-magnetic or non-magnetisable pigment particles may be comprised in the coating compositions described herein. These particles may be color organic or inorganic pigment particles known in the art, having or not having optically variable properties. Further, the particles may be spherical or platelet-shaped and may have isotropic or non-isotropic optical reflectivity.

The substrate described herein is preferably selected from the group consisting of papers or other fibrous materials, such as cellulose, paper-containing materials, glasses, metals, ceramics, plastics and polymers, metallised plastics or polymers, composite materials, and mixtures or combinations of two or more thereof. Typical paper, paper-like or other fibrous materials are made from a variety of fibres including without limitation abaca, cotton, linen, wood pulp, and blends thereof. As is well known to those skilled in the art, cotton and cotton/linen blends are preferred for banknotes, while wood pulp is commonly used in non-banknote security documents. Typical examples of plastics and polymers include polyolefins, such as polyethylene (PE) and polypropylene (PP), polyamides, polyesters such as poly (ethylene terephthalate) (PET), poly(1,4-butylene terephthalate) (PBT), poly(ethylene 2,6-naphthoate) (PEN), and polyvinylchlorides (PVC). Spunbond olefin fibres, such as those sold under the trademark Tyvek® may also be used as substrate. Typical examples of metalized plastics or polymers include the plastic or polymer materials described hereabove having a metal disposed continuously or discontinuously on their surface. Typical example of metals include without limitation aluminium (Al), chromium (Cr), copper (Cu), gold (Au), silver (Ag), alloys thereof, and combinations of two or more of the aforementioned metals. The metallization of the plastic or polymer materials described hereabove may be done by an electrodeposition process, a high-vacuum coating process or by a sputtering process. Typical examples of composite materials include without limitation multilayer structures or laminates of paper and at least one plastic or polymer material, such as those described hereabove, as well as plastic and/or polymer fibres incorporated in a paper-like or fibrous material, such as those described hereabove. Of course, the substrate can comprise further additives that are known to the skilled person, such as fillers, sizing agents, whiteners, processing aids, reinforcing or wet strengthening agents, etc. When the OELs produced according to the present disclosure are used for decorative or cosmetic purposes including for example fingernail lacquers, said OEL may be produced on other type of substrates including nails, artificial nails, or other parts of an animal or human being.

Should the OEL produced according to the present disclosure be on a security document, and with the aim of further increasing the security level and the resistance against counterfeiting and illegal reproduction of said security document, the substrate may comprise printed, coated, or laser-marked or laser-perforated indicia, watermarks, security threads, fibres, planchettes, luminescent compounds, windows, foils, decals, and combinations of two or more thereof. With the same aim of further increasing the security level and the resistance against counterfeiting and illegal reproduction of security documents, the substrate may comprise one or more marker substances or taggants and/or machine readable substances (e.g., luminescent substances, UV/visible/IR absorbing substances, magnetic substances, and combinations thereof).

The process described herein may further comprise one or more additional steps of exposing the coating composition described herein to the magnetic field of one or more additional static magnetic-field-generating devices thereby further mono-axially re-orienting the platelet-shaped magnetic or magnetisable pigment particles, i.e., the process described herein may further comprise a third, a fourth, etc. magnetic orientation step(s), said one or more additional steps may occur after step c) described herein and before step d) described herein.

After application of the coating composition on the substrate surface and the succession of orientation steps of the platelet-shaped magnetic or magnetisable pigment particles (steps a) to c)), the coating composition is hardened to a second state (i.e., turned to a solid or solid-like state) in order to fix the platelet-shaped magnetic or magnetisable pigment particles in their adopted positions and orientations. The hardening can be of purely physical nature, e.g. in cases where the coating composition comprises a polymeric binder material and a solvent, and is applied at high temperatures. Then, the platelet-shaped magnetic or magnetisable pigment particles are oriented at high temperature by the application of a magnetic field, and the solvent is evaporated, followed by cooling of the coating composition. Thereby the coating composition is hardened and the orientation of the pigment particles is fixed.

Alternatively and preferably, the "hardening" of the coating composition involves a chemical reaction, for instance by curing, which is not reversed by a simple temperature increase (e.g., up to 80° C.) that may occur during a typical use of a security document. The term "curing" or "curable" refers to processes including the chemical reaction, cross-linking or polymerization of at least one component in the applied coating composition in such a manner that it turns into a polymeric material having a greater molecular weight than the starting substances. Preferably, the curing causes the formation of a stable three-dimensional polymeric network. Such a curing is generally induced by applying an external stimulus to the coating composition (i) after its application on a substrate surface and (ii) subsequently to, or partially simultaneously with the mono-axial re-orientation of the platelet-shaped magnetic or magnetisable pigment particles (step c)). Advantageously, the hardening/curing (step d)) of the coating composition described herein is carried out partially simultaneously with the exposure of the coating composition to the static magnetic field of the second magnetic-field-generating device described herein (step c)). Therefore, preferably the coating composition is an ink or coating composition selected from the group consisting of radiation curable compositions, thermally drying compositions, oxidatively drying compositions, and combinations thereof. Particularly preferred are coating compositions selected from the group consisting of radiation curable compositions. Radiation curing, in particular UV-Vis curing, advantageously leads to an instantaneous increase in viscosity of the coating composition after exposure to the curing radiation, thus preventing any further movement of the pigment particles and in consequence any loss of information after the magnetic orientation step. Preferably, the hardening step (step d)) is carried out by radiation curing including UV-visible light radiation curing or by E-beam radiation curing, more preferably by UV-Vis light radiation curing.

Therefore, suitable coating compositions for the present disclosure include radiation curable compositions that may be cured by UV-visible light radiation (hereafter referred as UV-Vis-curable) or by E-beam radiation (hereafter referred as EB). Radiation curable compositions are known in the art and can be found in standard textbooks, such as the series "Chemistry & Technology of UV & EB Formulation for Coatings, Inks & Paints", Volume IV, Formulation, by C. Lowe, G. Webster, S. Kessel and I. McDonald, 1996 by John Wiley & Sons in association with SITA Technology Limited. According to one particularly preferred embodiment of the present disclosure, the coating composition described herein is a UV-Vis-curable coating composition. UV-Vis curing advantageously allows very fast curing processes and hence drastically decreases the preparation time of the OEL described herein, OEC described herein, and articles and documents comprising said OEL.

Preferably, the UV-Vis-curable coating composition comprises one or more compounds selected from the group consisting of radically curable compounds and cationically curable compounds. The UV-Vis-curable coating composition described herein may be a hybrid system and comprise a mixture of one or more cationically curable compounds and one or more radically curable compounds. Cationically curable compounds are cured by cationic mechanisms typically including the activation by radiation of one or more photoinitiators that liberate cationic species, such as acids, which in turn initiate the curing so as to react and/or cross-link the monomers and/or oligomers to thereby harden the coating composition. Radically curable compounds are cured by free radical mechanisms typically including the activation by radiation of one or more photoinitiators, thereby generating radicals, which in turn initiate the polymerization so as to harden the coating composition. Depending on the monomers, oligomers or prepolymers used to prepare the binder comprised in the UV-Vis-curable coating compositions described herein, different photoinitiators might be used. Suitable examples of free radical photoinitiators are known to those skilled in the art and include without limitation acetophenones, benzophenones, benzyldimethyl ketals, alpha-aminoketones, alpha-hydroxyketones, phosphine oxides, and phosphine oxide derivatives, as well as mixtures of two or more thereof. Suitable examples of cationic photoinitiators are known to those skilled in the art and include without limitation onium salts such as organic iodonium salts (e.g., diaryl iodoinium salts), oxonium (e.g., triaryloxonium salts) and sulfonium salts (e.g., triarylsulphonium salts), as well as mixtures of two or more thereof. Other examples of useful photoinitiators can be found in standard textbooks such as "Chemistry & Technology of UV & EB Formulation for Coatings, Inks & Paints", Volume III, "Photoinitiators for Free Radical Cationic and Anionic Polymerization", 2nd edition, by J. V. Crivello & K. Dietliker, edited by G. Bradley and published in 1998 by John Wiley & Sons in association with SITA Technology Limited. It may also be advantageous to include a sensitizer in conjunction with the one or more photoinitiators in order to achieve efficient curing. Typical examples of suitable photosensitizers include without limitation isopropyl-thioxanthone (ITX), 1-chloro-2-propoxy-thioxanthone (CPTX), 2-chloro-thioxanthone (CTX) and 2,4-diethyl-thioxanthone (DETX), and mixtures of two or more thereof. The one or more photoinitiators comprised in the UV-Vis-curable coating compositions are preferably present in a total amount from about 0.1 wt-% to about 20 wt-%, more preferably about 1 wt-% to about 15 wt-%, the weight percents being based on the total weight of the UV-Vis-curable coating compositions.

Alternatively, a polymeric thermoplastic binder material or a thermoset may be employed. Unlike thermosets, thermoplastic resins can be repeatedly melted and solidified by heating and cooling without incurring any important changes in properties. Typical examples of thermoplastic resin or polymer include without limitation polyamides, polyesters, polyacetals, polyolefins, styrenic polymers, polycarbonates, polyarylates, polyimides, polyether ether ketones (PEEK), polyetherketeoneketones (PEKK), polyphenylene based resins (e.g., polyphenylenethers, polyphenylene oxides, polyphenylene sulfides), polysulphones, and mixtures of two or more thereof.

The coating composition described herein may further comprise one or more marker substances or taggants and/or one or more machine readable materials selected from the group consisting of magnetic materials (different from the platelet-shaped magnetic or magnetisable pigment particles described herein), luminescent materials, electrically conductive materials, and infrared-absorbing materials. As used herein, the term "machine readable material" refers to a material that exhibits at least one distinctive property that is not perceptible by the naked eye, and which can be comprised in a layer so as to confer a way to authenticate said layer (or article comprising said layer) by the use of a particular equipment for its authentication.

The coating composition described herein may further comprise one or more colouring components selected from the group consisting of organic pigment particles, inorganic pigment particles, and organic dyes, and/or one or more additives. The latter include without limitation compounds and materials that are used for adjusting physical, rheological and chemical parameters of the coating composition, such as the viscosity (e.g., solvents, thickeners, and surfactants), the consistency (e.g., anti-settling agents, fillers, and plasticizers), the foaming properties (e.g., antifoaming agents), the lubricating properties (waxes, oils), UV stability (photostabilizers), the adhesion properties, the antistatic properties, the storage stability (polymerization inhibitors) etc. Additives described herein may be present in the coating composition in amounts and in forms known in the art, including so-called nano-materials where at least one of the dimensions of the additive is in the range of 1 to 1000 nm.

In the OELs described herein, the platelet-shaped magnetic or magnetisable pigment particles described herein are dispersed in the coating composition comprising a hardened binder material that fixes the orientation of the platelet-shaped magnetic or magnetisable pigment particles. The hardened binder material is at least partially transparent to electromagnetic radiation of a range of wavelengths comprised between 200 nm and 2500 nm. The binder material is thus, at least in its hardened or solid state (also referred to as second state herein), at least partially transparent to electromagnetic radiation of a range of wavelengths comprised between 200 nm and 2500 nm, i.e., within the wavelength range that is typically referred to as the "optical spectrum," which comprises infrared, visible and UV portions of the electromagnetic spectrum, such that the particles contained in the binder material in its hardened (or solid) state and their orientation-dependent reflectivity can be perceived through the binder material. Preferably, the hardened binder material is at least partially transparent to electromagnetic radiation of a range of wavelengths comprised between 200 nm and 800 nm, more preferably comprised between 400 nm and 700 nm. Herein, the term "transparent" denotes that the transmission of electromagnetic radiation through a layer of 20 μm of the hardened binder material as present in the OEL (not including the platelet-shaped magnetic or magnetisable pigment particles, but all other optional components of the OEL in case such components are present) is at least 50%, more preferably at least 60%, even more preferably at least 70%, at the wavelength(s) concerned. This can be determined, for example, by measuring the transmittance of a test piece of the hardened binder material (not including the platelet-shaped magnetic or magnetisable pigment particles) in accordance with well-established test methods, e.g., DIN 5036-3 (1979-11). If the OEL serves as a covert security feature, then typically technical approaches will be necessary to detect the (complete) optical effect generated by the OEL under respective illuminating conditions comprising the selected non-visible wavelength; said detection requiring that the wavelength of incident radiation is selected outside the visible range, e.g., in the near UV-range. In this case, it is preferable that the OEL comprises luminescent pigment particles that show luminescence in response to the selected wavelength outside the visible spectrum contained in the incident radiation. The infrared, visible and UV portions of the electromagnetic spectrum approximately correspond to the wavelength ranges between 700-2500 nm, 400-700 nm, and 200-400 nm, respectively.

Subsequently to, partially simultaneously with, or simultaneously with the application of the coating composition on a substrate surface (step a)), the platelet-shaped magnetic or magnetisable pigment particles are oriented by the use of the dynamic magnetic field of the first magnetic-field-generating device for bi-axially orienting them. The bi-axial orientation of the platelet-shaped magnetic or magnetisable pigment particles is also referred in the art as a two-axial alignment.

The step of exposing the coating composition comprising the binder material and the platelet-shaped magnetic or magnetisable pigment particles to the dynamic magnetic field of the first magnetic-field-generating device (step b)) can be performed either partially simultaneously or simultaneously with the step a) or subsequently to the step a). That is, steps a) and b) may be performed partially simultaneously, simultaneously or subsequently.

Figure 2:
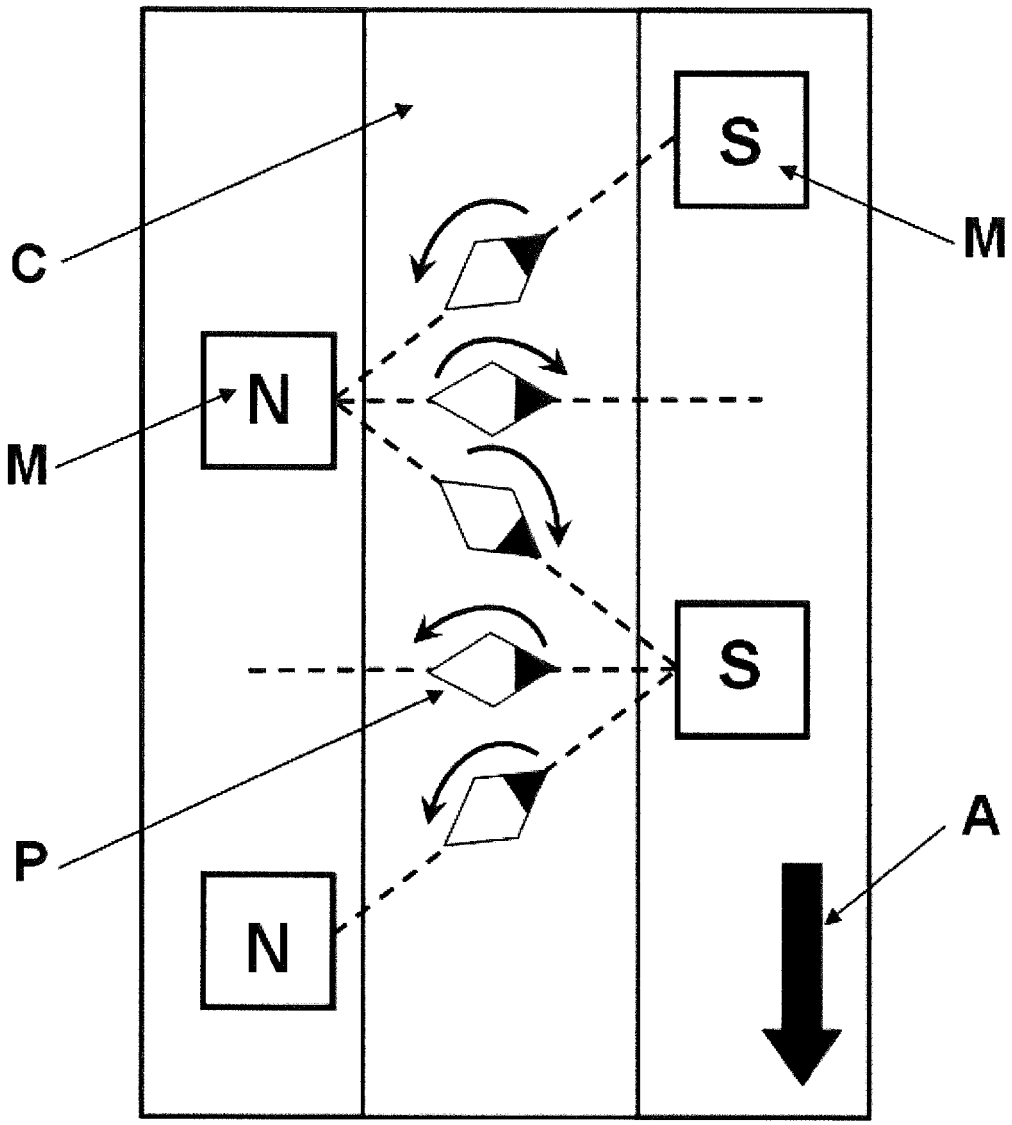
FIG. 2 schematically illustrates a first example of a first magnetic-field-generating device for bi-axially orienting magnetic or magnetisable platelet-shaped pigment particles.

Particularly preferred magnetic-field-generating devices for bi-axially orienting the platelet-shaped magnetic or magnetisable pigment particles are disclosed in EP 2 157 141 A1. The magnetic-field-generating device disclosed in EP 2 157 141 A1 provides a dynamic magnetic field that changes its direction forcing the platelet-shaped magnetic or magnetisable pigment particles to rapidly oscillate until both main axes, X-axis and Y-axis, become parallel to the substrate surface, i.e., the platelet-shaped magnetic or magnetisable pigment particles rotate until they come to the stable sheet-like formation with their X and Y axes parallel to the substrate surface and are planarised in said two dimensions. As shown in FIG. 2 (corresponding to FIG. 5 of EP 2 157 141), the first magnetic-field-generating device described herein comprises a linear arrangement of at least three magnets (M) that are positioned in a staggered fashion or in zigzag formation, said at least three magnets (M) being on opposite sides of a feedpath where magnets (M) at the same side of the feedpath have the same polarity, which is opposed to the polarity of the magnet(s) (M) on the opposing side of the feedpath in a staggered fashion. The arrangement of the at least three magnets (M) provides a predetermined change of the field direction as platelet-shaped magnetic or magnetisable pigment particles (P) in a coating composition (C) move by the magnets (direction of movement: arrow (A)). According to one embodiment, the first magnetic-field-generating device comprises a) a first magnet and a third magnet on a first side of a feedpath and b) a second magnet between the first and third magnets on a second opposite side of the feedpath, wherein the first and third magnets have a same polarity and wherein the second magnet has a complementary polarity to the first and third magnets. According to another embodiment (shown in FIG. 2), the first magnetic-field-generating device further comprises a fourth magnets (M) on the same side of the feedpath as the second magnet, having the polarity of the second magnet and complementary to the polarity of the third magnet. As described in EP 2 157 141 A1, the magnetic-field-generating device can be either underneath the layer comprising the platelet-shaped magnetic or magnetisable pigment particles, or above and underneath. Alternatively, the first magnetic-field-generating device described herein comprises an arrangement of rollers as shown in FIG. 9 of EP 2 157 141 A1, i.e., the first magnetic-field-generating device described herein comprises two spaced apart wheels having magnets thereon, the magnets having the same staggered configuration as those described hereabove.

Other particularly preferred magnetic-field-generating devices for bi-axially orienting the platelet-shaped magnetic or magnetisable pigment particles are of linear permanent magnet Halbach arrays, i.e., assemblies comprising a plurality of magnets with different magnetisation directions. Detailed description of Halbach permanent magnets was given by Z. Q. Zhu et D. Howe (Halbach permanent magnet machines and applications: a review, *IEE. Proc. Electric Power Appl.,* 2001, 148, p. 299-308). The magnetic field produced by such a Halbach array has the properties that it is concentrated on one side while being weakened almost to zero on the other side. Typically, linear permanent magnet Halbach arrays comprise one or more non-magnetic blocks made for example of wood or plastic, in particular plastics known to exhibit good self-lubricating properties and wear resistance such as polyacetal (also called polyoxymethylene, POM) resins, and magnets such as Neodymium-Iron-Boron (NdFeB) magnets.

Other particularly preferred magnetic-field-generating devices for bi-axially orienting the platelet-shaped magnetic or magnetisable pigment particles are spinning magnets, said magnets comprising disc-shaped spinning magnets or magnet assemblies that are essentially magnetised along their diameter. Suitable spinning magnets or magnet assemblies are described in US 2007/0172261 A1, now U.S. Pat. No. 7,934,451 said spinning magnets or magnet assemblies generate radially symmetrical time-variable magnetic fields, allowing the bi-orientation of platelet-shaped magnetic or magnetisable pigment particles of a not yet hardened coating composition. These magnets or magnet assemblies are driven by a shaft (or spindle) connected to an external motor. In a preferred embodiment, said magnets or magnet assemblies are shaft-free disc-shaped spinning magnets or magnet assemblies constrained in a housing made of non-magnetic, preferably non-conducting, materials and are driven by one or more magnet-wire coils wound around the housing. Optionally, one or more Hall-effect elements are placed along the housing such that they are able to detect the magnetic field generated by the spinning magnet or magnet assembly and to appropriately address the one or more magnet-wire coils with electric current. Such spinning magnets or magnet assemblies simultaneously serve as the rotor of an electric motor and as an orientator for platelet-shaped magnetic of magnetisable pigment particles of a not yet hardened coating composition. In this way, it is possible to limit the driving mechanism of the device to the strictly necessary parts and to strongly reduce its size. The magnetic-field-generating device can be either underneath the layer comprising the platelet-shaped magnetic or magnetisable pigment particles or aside said layer. Detailed description of such devices is given in the co-pending European patent application 13 195 717.7.

Subsequently to the exposure of the coating composition to the dynamic magnetic field of the first magnetic-field-generating device described herein (step b)), and while the coating composition is still wet or soft enough so that the platelet-shaped magnetic or magnetisable pigment particles therein can be further moved and rotated, the platelet-shaped magnetic or magnetisable pigment particles are further mono-axially re-oriented by the use of the static magnetic field of a second magnetic-field-generating device described herein for orienting them according to a desired orientation pattern (step c)). Said orientation pattern obtained in step c) may be any pattern except a random orientation. The desired orientation of the platelet-shaped magnetic or magnetisable pigment particles obtained by exposing them to the static magnetic field of the second magnetic-field-generating device (step c)) is chosen according to the end-use applications. By comprising the platelet-shaped magnetic or magnetisable pigment particles described herein, the coating composition is well-suited for use in printing OEL such as dynamic, three-dimensional, illusionary, and/or kinematic images by aligning the pigment particles within the coating composition with a magnetic field.

A large variety of optical effects OEL for decorative and security applications can be produced by various methods disclosed for example in U.S. Pat. No. 6,759,097, EP 2 165 774 A1 and EP 1 878 773 B1. OEL known as flip-flop effects (also referred in the art as switching effect) may be produced. Flip-flop effects include a first printed portion and a second printed portion separated by a transition, wherein pigment particles are aligned parallel to a first plane in the first portion and flakes in the second portion are aligned parallel to a second plane. Methods for producing flip-flop effects are disclosed for example in EP 1 819 525 B1 and EP 1 819 525 B1. Optical effects known as rolling-bar effects may also be produced. Rolling-bar effects show one or more contrasting bands which appear to move ("roll") as the image is tilted with respect to the viewing angle, said optical effects are based on a specific orientation of magnetic or magnetisable pigment particles, said pigment particles being aligned in a curving fashion, either following a convex curvature (also referred in the art as negative curved orientation) or a concave curvature (also referred in the art as positive curved orientation). Methods for producing rolling-bar effects are disclosed for example in EP 2 263 806 A1, EP 1 674 282 B1, EP 2 263 807 A1, WO 2004/007095 A2 and WO 2012/104098 A1. Optical effects known as Venetian-blind effects may also be produced. Venetian-blind effects include pigment particles being oriented such that, along a specific direction of observation, they give visibility to an underlying substrate surface, such that indicia or other features present on or in the substrate surface become apparent to the observer while they impede the visibility along another direction of observation. Methods for producing Venetian-blind effects are disclosed, for example, in U.S. Pat. No. 8,025,952 and EP 1 819 525 B1. Optical effects known as moving-ring effects may also be produced. Moving-ring effects consists of optically illusive images of objects such as funnels, cones, bowls, circles, ellipses, and hemispheres that appear to move in any x-y direction depending upon the angle of tilt of said optical effect layer. Methods for producing moving-ring effects are disclosed, for example, in EP 1 710 756 A1, U.S. Pat. No. 8,343,615, EP 2 306 222 A1, EP 2 325 677 A2, WO 2011/092502 A2, and US 2013/0084411 now U.S. Pat. No. 9,257,059.

The second magnetic-field-generating device described herein may comprise a magnetic plate carrying surface one or more reliefs, engravings or cut-outs. WO 2005/002866 A1 and WO 2008/046702 A1 are examples for such engraved magnetic plates.

The processes for producing the OEL described herein comprise, partially simultaneously with step c) or subsequently to step c), a step of hardening (step d)) the coating composition so as to fix the platelet-shaped magnetic or magnetisable pigment particles in their adopted positions and orientations in a desired pattern to form the OEL, thereby transforming the coating composition to a second state. By this fixing, a solid coating or layer is formed. In the context of the present disclosure, when the hardening step d) is performed partially simultaneously with the orientation step c), it must be understood that step d) must become effective after step c) so that pigment particles orient before complete hardening of the OEL.

The term "hardening" refers to processes including the drying or solidifying, reacting, curing, cross-linking or polymerizing the binder components in the applied coating composition, including an optionally present cross-linking agent, an optionally present polymerization initiator, and optionally present further additives, in such a manner that an essentially solid material that adheres to the substrate surface is formed. As mentioned herein, the hardening step (step d)) may be performed by using different approaches or processes depending on the binder material comprised in the coating composition that also comprises the platelet-shaped magnetic or magnetisable pigment particles.

The hardening step generally may be any step that increases the viscosity of the coating composition such that a substantially solid material adhering to the supporting surface is formed. The hardening step may involve a physical process based on the evaporation of a volatile component, such as a solvent, and/or water evaporation (i.e., physical drying). Herein, hot air, infrared or a combination of hot air and infrared may be used. Alternatively, the hardening process may include a chemical reaction, such as a curing, polymerizing, or cross-linking of the binder and optional initiator compounds and/or optional cross-linking compounds comprised in the coating composition. Such a chemical reaction may be initiated by heat or IR irradiation as outlined above for the physical hardening processes, but may preferably include the initiation of a chemical reaction by a radiation mechanism including without limitation Ultraviolet-Visible light radiation curing (hereafter referred as UV-Vis curing) and electronic beam radiation curing (E-beam curing); oxypolymerization (oxidative reticulation, typically induced by a joint action of oxygen and one or more catalysts preferably selected from the group consisting of cobalt-containing catalysts, vanadium-containing catalysts, zirconium-containing catalysts, bismuth-containing catalysts, and manganese-containing catalysts); cross-linking reactions, or any combination thereof.

Radiation curing is particularly preferred, and UV-Vis light radiation curing is even more preferred, since these technologies advantageously lead to very fast curing processes, and hence drastically decrease the preparation time of any article comprising the OEL described herein. Moreover, radiation curing has the advantage of producing an almost instantaneous increase in viscosity of the coating composition after exposure to the curing radiation, thus minimizing any further movement of the particles. In consequence, any loss of orientation after the magnetic orientation step can essentially be avoided. Particularly preferred is radiation-curing by photo-polymerization, under the influence of actinic light having a wavelength component in the UV or blue part of the electromagnetic spectrum (typically 200 nm to 650 nm; more preferably 200 nm to 420 nm). Equipment for UV-visible-curing may comprise a high-power light-emitting-diode (LED) lamp, or an arc discharge lamp, such as a medium-pressure mercury arc (MPMA) or a metal-vapour arc lamp, as the source of the actinic radiation. The hardening step (step d)) can be performed either partially simultaneously with step c) or subsequently to step c). However, the time from the end of step c) to the beginning of step d) is preferably relatively short in order to avoid any de-orientation and loss of information. Typically, the time between the end of step c) and the beginning of step d) is less than 1 minute, preferably less than 20 seconds, further preferably less than 5 seconds, even more preferably less than 1 second. It is particularly preferable that there is essentially no time gap between the end of the orientation step c) and the beginning of the hardening step d), i.e., that step d) follows immediately after step c) or already starts while step c) is still in progress.

If desired, a primer layer may be applied to the substrate prior to the step a). This may enhance the quality of the OEL described herein or promote adhesion. Examples of such primer layers may be found in WO 2010/058026 A2.

With the aim of increasing the durability through soiling or chemical resistance and cleanliness and thus the circulation lifetime of an article, a security document or a decorative element or object comprising the OEL described herein, or with the aim of modifying their aesthetical appearance (e.g., optical gloss), one or more protective layers may be applied on top of the OEL. When present, the one or more protective layers are typically made of protective varnishes. These may be transparent or slightly coloured or tinted, and may be more or less glossy. Protective varnishes may be radiation curable compositions, thermal drying compositions or any combination thereof. Preferably, the one or more protective layers are radiation curable compositions, more preferable UV-Vis curable compositions. The protective layers may be applied after the formation of the OEL in step d).

The OEL described herein may be provided directly on a substrate on which it shall remain permanently (such as for banknote applications). Alternatively, an OEL may also be provided on a temporary substrate for production purposes, from which the OEL is subsequently removed. This may for example facilitate the production of the OEL, particularly while the binder material is still in its fluid state. Thereafter, after hardening the coating composition for the production of the OEL, the temporary substrate may be removed from the OEL. Of course, in such cases the coating composition must be in a form that is physically integral after the hardening step, such as for instances in cases where a plastic-like or sheet-like material is formed by the hardening. Thereby, a film-like transparent and/or translucent material consisting of the OEL as such (i.e., essentially consisting of oriented platelet-shaped magnetic or magnetisable pigment particles having non-isotropic reflectivity, hardened binder components for fixing the pigment particles in their orientation and forming a film-like material, such as a plastic film, and further optional components) can be provided.

Alternatively, in another embodiment an adhesive layer may be present on the OEL or may be present on the substrate comprising an OEL, said adhesive layer being on the side of the substrate opposite the side where the OEL is provided or on the same side as the OEL and on top of the OEL. Therefore an adhesive layer may be applied to the OEL or to the substrate, said adhesive layer being preferably applied after the hardening step has been completed. In such instances, an adhesive label comprising the adhesive layer and the OEL or an adhesive layer, the OEL and the substrate as the case may be formed. Such a label may be attached to all kinds of documents or other articles or items without printing or other processes involving machinery and rather high effort.

Also described herein are optical effect coated substrates (OECs) comprising one or more OELs such as those described herein. The OECs described herein may comprise the substrate described herein on which the one or more OELs shall remain permanently (such as for banknote applications). Alternatively, the OECs described herein may be in the form of a transfer foil, which can be applied to a document or to an article in a separate transfer step. For this purpose, the substrate is provided with a release coating, on which one or more OELs are produced as described herein. One or more adhesive layers may be applied over the so produced OEL.

According to one embodiment of the present disclosure, the optical effect coated substrate comprises more than one OEL on the substrate described herein, for example it may comprise two, three, etc. OELs. The OEC may comprise a first OEL and a second OEL, wherein both of them are present on the same side of the substrate, or wherein one is present on one side of the substrate and the other one is present on the other side of the substrate. If provided on the same side of the substrate, the first and the second OELs may be adjacent or not adjacent to each other. Additionally or alternatively, one of the OELs may partially or fully superimpose the other OEL. The magnetic orientation of the platelet-shaped magnetic or magnetisable pigment particles for producing the first OEL and of the platelet-shaped magnetic or magnetisable pigment particles for producing the second OEL may be performed simultaneously or sequentially, with or without intermediate hardening or partial hardening of the binder material.

Also described herein are articles, in particular security documents, decorative elements or objects, comprising the OEL produced according to the present disclosure. The articles, in particular security documents, decorative elements, or objects, may comprise more than one (for example two, three, etc.) OELs produced according to the present disclosure. For example, the article, in particular security document or the decorative element or object, may comprise a first OEL and a second OEL, wherein both of them are present on the same side of the substrate or wherein one is present on one side of the substrate and the other one is present on the other side of the substrate. If provided on the same side of the substrate, the first and the second OELs may be adjacent or not adjacent to each other. Additionally or alternatively, one of the OELs may partially or fully superimpose the other OEL.

As mentioned hereabove, the OELs produced according to the present disclosure may be used for decorative purposes as well as for protecting and authenticating a security document.

Typical examples of decorative elements or objects include without limitation luxury goods, cosmetic packaging, automotive parts, electronic/electrical appliances, furniture, and fingernail lacquers.

Security documents include without limitation value documents and value commercial goods. Typical example of value documents include without limitation banknotes, deeds, tickets, checks, vouchers, fiscal stamps and tax labels, agreements and the like, identity documents such as passports, identity cards, visas, driving licenses, bank cards, credit cards, transactions cards, access documents or cards, entrance tickets, public transportation tickets or titles, and the like, preferably banknotes, identity documents, right-conferring documents, driving licenses, and credit cards. The term "value commercial good" refers to packaging materials, in particular for cosmetic articles, nutraceutical articles, pharmaceutical articles, alcohols, tobacco articles, beverages or foodstuffs, electrical/electronics articles, fabrics, or jewellery, i.e., articles that shall be protected against counterfeiting and/or illegal reproduction in order to warrant the content of the packaging like for instance genuine drugs. Examples of these packaging materials include without limitation labels, such as authentication brand labels, tamper evidence labels, and seals. It is pointed out that the disclosed substrates, value documents and value commercial goods are given exclusively for exemplifying purposes, without restricting the scope of the disclosure. Alternatively, the OEL may be produced onto an auxiliary substrate such as for example a security thread, security stripe, a foil, a decal, a window, or a label, and consequently transferred to a security document in a separate step. As mentioned hereabove, the articles described herein, in particular security documents, decorative elements or objects, may comprise more than one (for example two, three, etc.) OEL produced according to the present disclosure. In such a case, the coating composition described herein may be applied on the substrate surface described herein so as to form a first OEL and a second OEL may be applied to said substrate surface in the form of an auxiliary substrate such as those described hereabove, wherein the second OEL is subsequently transferred to the substrate surface already comprising the first OEL. Alternatively, a coating composition such as those described herein may be applied on a first auxiliary substrate such as those described hereabove so as to form a first OEL and a coating composition such as those described herein may be applied on a second auxiliary substrate such as those described hereabove so as to form a second OEL, wherein the first and second OELS are subsequently transferred to a substrate surface such as those described herein.

As mentioned hereabove, the process described herein advantageously allows the user to produce OELs with reduced thickness and therefore increased flexibility in comparison with the prior art, for example by using small platelet-shaped magnetic or magnetisable pigment particles and printing process being, for example, a rotogravure printing process or a flexography printing process. This advantage may be of high importance for the production of security documents or articles consisting of multilayer structures. Typical examples of such multilayer structures include for example articles, in particular security documents, decorative elements or objects, comprising more than one (for example two, three, etc.) OELs produced according to the present disclosure and security threads or stripes that are incorporated into or onto a banknote, wherein thick security threads or stripes may cause difficulties during their integration into or onto a banknote.

The skilled person can envisage several modifications to the specific embodiments described above without departing from the spirit of the present disclosure. Such modifications are encompassed by the present disclosure.

Further, all documents referred to throughout this specification are hereby incorporated by reference in their entirety as set forth in full herein.

The present disclosure will now be described by way of Examples, which are however not intended to limit its scope in any way.

EXAMPLES

TABLE 1

| | |
|---|---|
| Epoxyacrylate oligomer | 36% |
| Trimethylolpropane triacrylate monomer | 13.5% |
| Tripropyleneglycol diacrylate monomer | 20% |
| Genorad 16 (Rahn) | 1% |
| Aerosil 200 ® (Evonik) | 1% |
| Speedcure TPO-L (Lambson) | 2% |
| Irgacure ® 500 (BASF) | 6% |
| Genocure EPD (Rahn) | 2% |
| Tego Foamex N (Evonik) | 2% |
| 7-layer optically variable magnetic pigment particles (*) | 16.5% |

(*) 7-layer gold-to-green platelet-shaped optically variable magnetic pigment particles with particle size d50 = 4.5 μm and a thickness of about 1 μm, obtained from JDS-Uniphase, Santa Rosa, CA.

In the following examples 1 and 2, the coating composition described in Table 1 was applied on a black paper substrate (Gascogne Laminates M-cote 120) by hand screen printing using a T90 mesh screen so as to form a pattern (35 mm×35 mm) having a thickness of about 15 μm.

Example 1

An OEL was obtained by applying the coating composition described in Table 1 on the paper substrate described hereabove. The platelet-shaped optically variable magnetic pigment particles were oriented in two steps:

i) exposing the not yet hardened coating composition at a distance of 5 mm to a magnetic-field-generating device comprising:

a) a nickel-coated NdFeB disk-shaped permanent magnet (M1) (Webcraft GmbH) of diameter 35 mm and thickness 2 mm, magnetized along its diameter. The magnet was placed inside the central cylindrical cavity (diameter: 35.3 mm, depth: 2.3 mm) of a square shaped housing made of polyoxymethylene (Maagtechnic Daetwyler), b) a magnet-wire coil (POLYSOL 155 1X0.15 mm HG Distrelec AG) wound around the assembly over a length of 35 mm, in two tight layers. The magnet-wire coil comprised a total of 240 turns, and c) a single phase motion controller (MC) (DIODES AH5771) to drive the magnet-wire coil. The Hall element of the motion controller was placed in the middle of the outer side of the magnet-wire coil.

This magnetic-field-generating device was powered by 4.5V, type 3LR12, battery (Varta). The platelet-shaped optically variable magnetic pigment particles were thus biaxially oriented such that their X-Y plane parallel to an imaginary spheroid surface; and ii) exposing the not yet hardened coating composition obtained under step i) to the magnetic field of a magnetic-field-generating device disclosed in FIG. 1 of WO 2008/046702 A1. The device comprised a NdFeB magnetic plate (3 in FIG. 1 of WO 2008/046702 A1, dimensions: 30 mm×18 mm×6 mm, magnetised along its width, supplier: Webcraft AG) and an engraved magnetic plate (2 in FIG. 1 of WO 2008/046702 A1) placed at a distance of 5 mm from the NdFeB magnetic plate. The engraved magnetic plate was made of Plastoferrite (Max Baermann TX928), had the dimensions of 38 mm×38 mm×1 mm (length×width×height), magnetised along its height and carrying an engraving of the letter "A" (5 mm height×0.5 mm depth).

The platelet-shaped optically variable magnetic pigment particles were thus oriented such that they exhibited the A "letter" and a rolling bar effect (as shown in FIG. 7*b* of U.S. Pat. No. 7,047,883 B2) superimposed onto the spherical effect obtained during the first, bi-axial orientation step.

The so-obtained magnetic orientation pattern of the platelet-shaped optically variable pigment particles was subsequently fixed by exposing the not yet hardened coating composition during 0.5 seconds to a UV LED (Phoseon Technology LED UV RX FireFlex™ 75x50WC395-8W).

Figure 3D:
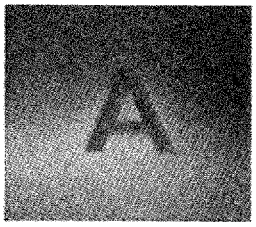
FIG. 3A-E shows photographic images of an OEL, said OEL comprising oriented platelet-shaped magnetic or magnetisable pigment particles and being produced by a process according to the present disclosure.
Figure 3B:
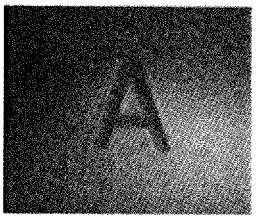
Figure 3A:
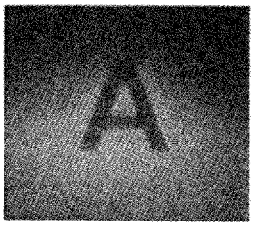
Figure 3C:
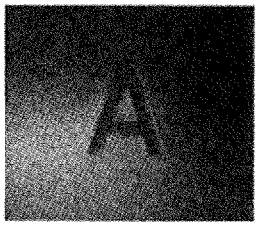
Figure 3E:
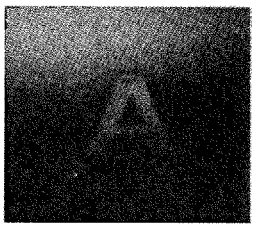

Photographic images (Lighting: Reflecta LED Videolight RPL49, Objective: AF-S Micro Nikkor 105 mm 1:2.8 G ED; Camera: Nikon D800, manual exposure, with automatic digital image enhancement options disabled for consistency) of the OEL comprising the oriented platelet-shaped optically variable magnetic pigment particles oriented are shown in FIGS. 3A-3E. FIG. 3A shows the OEL viewed perpendicular to the OEL's surface. FIG. 3B shows the OEL tilted at 30° clock-wise vertically. FIG. 3C shows the OEL tilted at 30° counter clock-wise vertically. FIG. 3D shows the OEL tilted at 30° clock-wise horizontally. FIG. 3E shows the OEL tilted at 30° counter clock-wise horizontally.

In contrast with the OEL obtained using only the device WO 2008/046702 A1 (FIG. 1), the example described herein exhibited a bright reflection that moved in all four directions upon tilting (up-down-left-right) along with the "A" letter. Moreover, there was no apparent graininess in the OEL produced according to the disclosure.

Example 2

Figure 4:
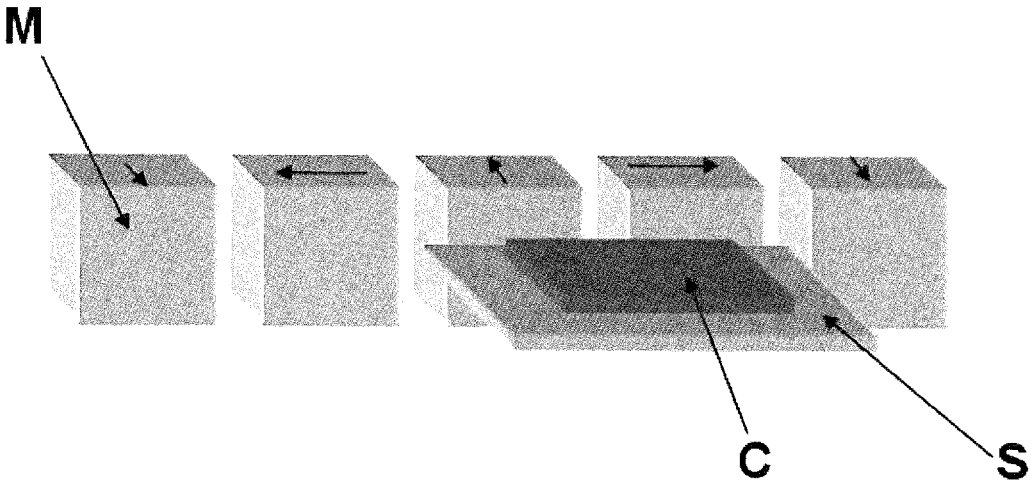
FIG. 4 schematically illustrates an example of a first magnetic-field-generating device for bi-axially orienting platelet-shaped magnetic or magnetisable pigment particles.

An OEL was obtained by applying the coating composition described in Table 1 on the paper substrate described hereabove. The platelet-shaped optically variable magnetic pigment particles were oriented in two steps:

i) exposing not yet hardened coating composition (C) to the magnetic field of a linear Halbach array depicted in FIG. 4. The linear Halbach array comprised 5 NdFeB N42 magnets (M), each having the dimensions 15 mm×15 mm×10 mm (length×width×height, alternatively magnetised along their length or their width); the magnets were fixed in the recesses of a holder made of a non-magnetic material (not shown in the Figure for clarity), the distance between each of the magnets was 2 mm. The substrate (S) carrying the coating composition (C) was moved back and forth eight times at a linear speed of 10 cm/s in a direction parallel to the magnet array, at half the height of the magnet array and at a 2 mm distance from the surface of the magnets facing the sample. The back and forth movement was confined within the magnet assembly. The platelet-shaped optically variable magnetic pigment particles were thus oriented such that both their X-axis and Y-axis were substantially parallel to the substrate surface; and ii) exposing the not yet hardened coating composition containing the platelet-shaped optically variable magnetic pigment particles oriented as described in the first step to the magnetic field of a same second magnetic-field-generating device described for Example 1 shown in the FIG. 7c of U.S. Pat. No. 7,047,883 B2.

The so-obtained magnetic orientation pattern of the platelet-shaped optically variable pigment particles led to an OEL exhibiting a rolling bar effect. Said so-obtained magnetic orientation pattern was, partially simultaneously with the exposure step to the second magnetic-field-generating device (as described in WO 2012/038531 A1), fixed by exposing the not yet hardened coating composition during 0.5 seconds to a UV LED (Phoseon Technology LED UV RX FireFlex™ 75x50WC395-8W).

The brightness of the so-obtained OEL was quantified by measuring the lightness at bright area of greyscale 8-bit photographic images, using a commercially available software (Adobe Photoshop CS4). The lightness scale was 0 (full black) to 255 (full white). The greyscale 8-bit photographic images of the OEL of Example 2 were obtained with the following settings:

- lighting: Reflecta LED Videolight RPL49, positioned at a 45° angle to the OEL and at a distance of 110 mm,
- camera: Nikon D800, ISO 800, aperture F/36, speed 1/60s, colour temperature 5700K,
- objective: AF-S Micro Nikkor 105 mm 1:2.8 G ED, manual focus at 37 cm
- software—Camera Control Pro 2.14.0 W, automatic digital image enhancement options disabled, and
- raw file converted as is (no parameters to be changed) to color TIFF 8-bit by NXviewer software supplied with camera.

Figure 5A:
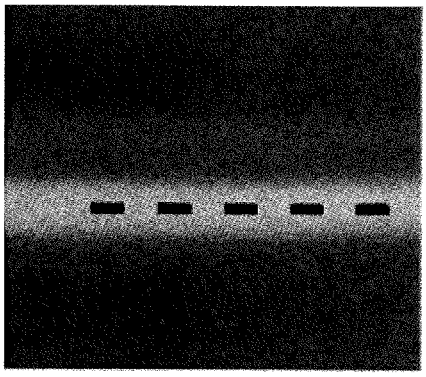
FIGS. 5A-5B shows photographic images of an OEL, said OEL comprising oriented platelet shaped magnetic or magnetisable pigment particles and being produced by a process according to the present invention disclosure.
Figure 5B:
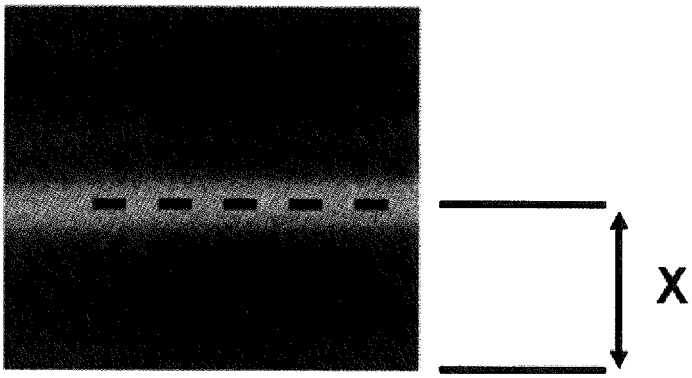

The so-obtained photographic image of the OEL prepared according to the present disclosure is shown in FIG. 5A. For comparative purpose, an OEL obtained using only the second orientation step described hereabove was obtained with the same settings as described hereabove. The resulting photographic image is shown in FIG. 5B. A dotted line comprising 5 line segments was drawn inside the bright area of FIGS. 5A and 5B. The average lightness of each segment of the dotted line was determined and an average value $v_b$ was calculated. This gave an average brightness value $V_b$=164 for FIG. 5*a* and $V_b^{ref}$=115 for FIG. 5*b*. The two-step magnetisation method described herein resulted therefore in a brightness increase $\Delta V_b$ of 42%, the brightness increase being defined as $\Delta V_b=((V_b-V_b^{ref})/V_b^{ref})*100$. In FIGS. 5A and 5B, X represents the distance between the extremity of the OEL and the centre of the rolling bar and is 5.5 mm.

The invention claimed is:

1. A process for producing an optical effect layer (OEL) on a substrate, said process comprising:

a) applying on a substrate surface a coating composition comprising: i) platelet-shaped magnetic or magnetisable pigment particles; and ii) a binder material, said coating composition being in a first state, b) exposing the coating composition to a dynamic magnetic field of a first magnetic-field generating device so as to bi-axially orient at least a part of the platelet-shaped magnetic or magnetisable pigment particles, c) exposing the coating composition exposed to the dynamic magnetic field to a static magnetic field of a second magnetic-field-generating device, thereby mono-axially re-orienting at least a part of the platelet-shaped magnetic or magnetisable pigment particles, and d) hardening the coating composition exposed to the static magnetic field to a second state so as to fix the platelet-shaped magnetic or magnetisable pigment particles in their adopted positions and orientations.

2. The process according to claim 1, wherein the exposing the coating composition to the dynamic magnetic field is carried out so as to bi-axially orient at least a part of the platelet-shaped magnetic or magnetisable pigment particles: i) to have both their X-axis and Y-axis substantially parallel to the substrate surface; ii) to have a first axis within the X-Y plane substantially parallel to the substrate surface and a second axis perpendicular to said first axis at a substantially non-zero elevation angle to the substrate surface; or iii) to have their X-Y plane parallel to an imaginary spheroid surface.

3. The process according to claim 1, wherein the hardening is carried out by UV-Vis light radiation curing.

4. The process according to claim 1, wherein the hardening is carried out partially simultaneously with the exposing the coating composition to the static magic field.

5. The process according to claim 1, wherein at least a part of the platelet-shaped magnetic or magnetisable pigment particles comprises a magnetic metal selected from the group consisting of cobalt (Co), iron (Fe), gadolinium (Gd) and nickel (Ni); a magnetic alloy of iron, manganese, cobalt, nickel or a mixture of two or more thereof; a magnetic oxide of chromium, manganese, cobalt, iron, nickel, or a mixture of two or more thereof; or a mixture of two or more thereof.

6. The process according to claim 1, wherein the substrate is selected from the group consisting of: papers or other fibrous materials, paper-containing materials, glasses, metals, ceramics, plastics and polymers, metalized plastics or polymers, composite materials and mixtures or combinations thereof.

7. Method of manufacturing a security document or a decorative element or object with an optical effect layer, comprising:

providing a security document or a decorative element or object, and providing the optical effect layer to the security document or decorative element or object according to the process of claim 1 so that the optical effect layer is comprised by the security document or decorative element or object.

8. The process according to claim 1, wherein the applying is carried out by a printing process.

9. The process according to claim 8, wherein the printing process is selected from the group consisting of screen printing, rotogravure, flexography printing and intaglio printing.

10. The process according to claim 1, wherein the coating composition comprises the platelet-shaped magnetic or magnetisable pigment particles in an amount from about 2 wt-% to about 40 wt-%, the weight percents being based on the total weight of the coating composition.

11. The process according to claim 10, wherein the coating composition comprises the platelet-shaped magnetic or magnetisable pigment particles in an amount from about 4 wt-% to about 30 wt-%, the weight percents being based on the total weight of the coating composition.

12. The process according to claim 1, wherein at least a part of the platelet-shaped magnetic or magnetisable pigment particles comprises platelet-shaped optically variable magnetic or magnetisable pigment particles.

13. The process according to claim 12, wherein the platelet-shaped optically variable magnetic or magnetisable pigment particles are selected from the group consisting of platelet-shaped magnetic thin-film interference pigment particles, platelet-shaped magnetic cholesteric liquid crystal pigment particles, platelet-shaped interference coated pigment particles comprising a magnetic material, and mixtures of two or more thereof.

14. The process according to claim 13, wherein the magnetic thin-film interference flakes comprise a 5-layer Fabry-Perot absorber/dielectric/reflector/dielectric/absorber multilayer structure wherein the reflector and/or the absorber is a magnetic layer comprising nickel, iron, and/or cobalt; and/or a magnetic alloy comprising nickel, iron, and/or cobalt; and/or a magnetic oxide comprising nickel (Ni), iron (Fe), and/or cobalt (Co).

15. The process according to claim 13, wherein the magnetic thin-film interference flakes comprise a seven-layer Fabry-Perot absorber/dielectric/reflector/magnetic/reflector/dielectric/absorber multilayer structure or a six-layer Fabry-Perot multilayer absorber/dielectric/reflector/magnetic/dielectric/absorber multilayer structure, wherein the magnetic layer comprises nickel, iron and/or cobalt, and/or a magnetic alloy comprising nickel, iron, and/or cobalt and/or a magnetic oxide comprising nickel, iron, and/or cobalt.

16. The process according to claim 14, wherein the reflector layers are independently made from one or more materials selected from the group consisting of aluminium, chromium, nickel, and alloys thereof; and/or the dielectric layers are independently made from one or more materials selected from the group consisting of: magnesium fluoride and silicium dioxide; and/or the absorber layers are independently made from one or more materials selected from the group consisting of: chromium, nickel and alloys thereof.

* * * * *